US005153381A

United States Patent [19]

Ganatra et al.

[11] Patent Number: 5,153,381

[45] Date of Patent: Oct. 6, 1992

[54] METAL CLAD CABLE AND METHOD OF MAKING

[75] Inventors: Ravindra H. Ganatra, Sedalia, Mo.; Nicholas A. Long, Williamsport; Donald L. Weaver, Jr., Jersey Shore, both of Pa.

[73] Assignee: Alcan Aluminum Corporation, Cleveland, Ohio

[21] Appl. No.: 496,376

[22] Filed: Mar. 20, 1990

[51] Int. Cl.[5] ..... H01B 7/18

[52] U.S. Cl. ..... 174/102 R; 174/102 D; 174/109

[58] Field of Search ..... 174/102 R, 102 D, 108, 174/109

[56] References Cited

U.S. PATENT DOCUMENTS

| | | | |
|---|---|---|---|
| 1,948,616 | 7/1930 | Fischer | 174/103 |
| 2,018,939 | 10/1935 | Wertzheiser et al. | 174/109 X |
| 2,234,675 | 3/1941 | Johnson | 174/27 |
| 2,691,694 | 10/1954 | Young | 174/121 R |
| 3,299,202 | 1/1967 | Brown | 174/121 R |
| 3,509,269 | 4/1970 | Elliott | 174/120 R |
| 3,614,299 | 10/1971 | Grail | 174/107 |
| 3,692,925 | 9/1972 | Kindij | 174/120 C |
| 3,812,283 | 5/1974 | Kothe et al. | 174/105 R |
| 4,096,351 | 6/1978 | Wargin et al. | 174/102 R |
| 4,376,229 | 3/1983 | Maul et al. | 174/35 R |
| 4,449,013 | 5/1984 | Garschick | 174/103 |
| 4,552,989 | 11/1985 | Sass | 174/103 |
| 4,600,805 | 7/1986 | Glynn et al. | 174/102 R |
| 4,677,418 | 6/1987 | Shulver | 174/102 R X |
| 4,749,823 | 6/1988 | Ziemek et al. | 174/103 |

FOREIGN PATENT DOCUMENTS

| | | | |
|---|---|---|---|
| 269534 | 2/1965 | Canada | 174/108 |

OTHER PUBLICATIONS

Standard For Safety (Specification No. UL 1569) pp. 17-18, Oct. 22, 1987.

*Primary Examiner*—Morris H. Nimmo

*Attorney, Agent, or Firm*—Calfee, Halter & Griswold

[57] ABSTRACT

An electrical cable and method for making the same. The cable includes a plurality of conductors formed into a bundle and surrounded by an armor sheath. A barrier, formed of polyester or polypropylene tape, is disposed directly between the bundle of conductors and armor sheath. The tape is formed into layers, each layer extending over the length of the bundle of conductors. The tape has a thickness of about 1.5 to 2.0 mils. The preferred form of tape has longitudinally extending corrugations providing a corrugated thickness of 8.0 to 10.0 mils. Each layer of tape is applied either helically or longitudinally wrapping the tape around the bundle of conductors. The barrier separates the bundle of conductors and the armor sheath and provides impact resistance against the armor sheath being driven into contact with the conductors.

11 Claims, 3 Drawing Sheets

METAL CLAD CABLE AND METHOD OF MAKING

FIELD OF THE INVENTION

The present invention relates to a cable construction and a method for making the same. The cable includes a plurality of conductors formed into a bundle and surrounded by an armor sheath. A barrier, formed of polyester or polypropylene tape, is disposed directly between the bundle of conductors and the armor sheath. The tape is formed into layers, each layer extending over the length of the bundle of conductors. Each layer of tape is applied either helically or longitudinally wrapping the tape around the bundle of conductors. The barrier provides impact resistance against the armor sheath being driven into contact with the conductors.

BACKGROUND OF THE INVENTION

Electrical cables used in home or office construction generally comprise a plurality of conductors formed into a bundle and wrapped with a layer of metal armor to protect the conductors against mechanical damage and abuse. Such cables are commonly referred to as Metal Clad Cables and are described in Underwriters Laboratories Inc. Specification Number 1569. In such cables, the conductors generally comprise strands of conductive material, each strand being individually surrounded by a sleeve of insulating material.

Such types of electrical cables often have to perform under adverse conditions. For example, such types of electrical cables must be able to withstand flexing and abuse by the installers and the inhabitants. Further, such types of cables must be able to withstand impact with various items during installation or operation in a home or office.

One known form of electrical cable designed for use in a home or office has a barrier comprising a single layer of non-conductive tape surrounding the bundle of conductors and disposed between the bundle of conductors and the armor sheath. The single layer of non-conductive tape is generally at least 2.0 mils thick to conform to the UL 1569 specification. The layer of tape secures the conductors into a bundle during manufacture and protects the conductors against mechanical damage. However, applicants have determined that under certain impact conditions, a cable with a barrier applied as a single layer of tape can have the armor sheath driven into contact with the conductors. For example, if a force equivalent to a 50 lb. weight dropped from a height of 1 foot (per Section 19 of UL 1569) is applied to a cable with a barrier formed by a single layer of tape, the armor sheath can be driven through the layer of tape and into contact with the conductors. When the metal armor sheath is driven into contact with the conductors, it can short out the cable.

SUMMARY OF THE INVENTION

The present invention relates to an electrical cable having what the applicants believe to be surprisingly increased impact resistance in comparison to a cable with a barrier applied as a single layer of tape. The cable of the invention provides a barrier comprising polyester or polypropylene tape applied in plural (preferably two) layers, each layer extending the length of the cable and disposed between the bundle of conductors and the armor sheath. The tape is applied directly about the bundle of conductors to form a first (or inner) layer covering the bundle of conductors. The tape is applied directly about the first layer to form a second layer covering the first layer. According to the preferred embodiment, the second layer forms the outer layer of the barrier, and an armor sheath is applied directly about the second layer to complete the cable. The barrier layers formed of the polyester or polypropylene tape separate the armor sheath from the bundle of conductors and provide impact resistance against the armor sheath being driven into contact with the conductors. The barrier layers formed of the polyester or polypropylene tape provide what applicants believe to be a dramatic increase in the impact resistance of the cable as compared to cables with a barrier comprising only a single layer of non-conductive tape.

In the cable, each conductor (except for a groundwire) generally comprises a strand of conductive material surrounded by a layer (sleeve) of insulation. The conductors and the groundwire are formed into a bundle and surrounded by an armor sheath. The armor sheath typically comprises a conductive metal with a high strength characteristic, and is formed in a helical fashion around the bundle of conductors. The barrier is disposed directly between the bundle of conductors and the armor sheath to separate the armor sheath from the conductors, and to provide impact resistance against the armor sheath being driven into contact with the conductors.

According to the preferred form of the invention, the barrier consists of polyester or polypropylene tape formed into two layers. The tape has a thickness of between about 1.5 mils to 2.0 mils. The tape has longitudinally extending corrugations, providing a corrugated thickness of 8.0 to 10.0 mils. Moreover, each layer formed by the tape extends over the length of the bundle of conductors. A first layer is formed by wrapping the polyester or polypropylene tape helically around the bundle of conductors to cover the bundle of conductors. A second layer is formed by wrapping polyester or polypropylene tape helically about the first layer to cover the first layer. The armor is formed directly about the second layer of tape.

In a modified form of the invention, the barrier again consists of plural layers, each formed of polyester or polypropylene tape, but each layer is formed by a length of the tape extended longitudinally over the length of the bundle of conductors. A first layer is formed by a length of the tape extended longitudinally over the length of the bundle of conductors and applied directly about the bundle of conductors to cover the bundle of conductors. The other layer is formed by a length of the tape extended longitudinally over the first layer and applied directly about the first layer to cover the first layer. The armor is formed about the second layer of tape.

According to the preferred form of the invention, the barrier, which is formed of the corrugated tape, has a thickness of between about 16.0 mils and 20.0 mils. The barrier is disposed immediately adjacent to the outer side of the bundle of conductors and immediately adjacent to the inner side of the armor sheath. The polyester or polypropylene tape which forms the barrier can deform elastically under impact, to reduce the possibility that the armor sheath will penetrate the barrier formed by the tape and contact the conductor. Applicants believe the barrier, in the foregoing thickness range, is particularly useful because it provides substantial impact resistance, and yet allows the overall profile (i.e. diameter) of the cable to be relatively small.

The resulting cable is relatively simple and inexpensive to manufacture and has surprisingly high impact resistance against the armor sheath being forced against the conductors when the cable is impacted. Moreover, the impact resistance provided by the barrier enables the tape, the layers formed from the tape, and the conductors protected by the barrier, to be relatively thin. Thus, the overall profile of the cable can be maintained relatively small.

Further features and advantages of the present invention will become further apparent from the following detailed description and the accompanying drawings.

DESCRIPTION OF THE PREFERRED EMBODIMENT

Figure 1:
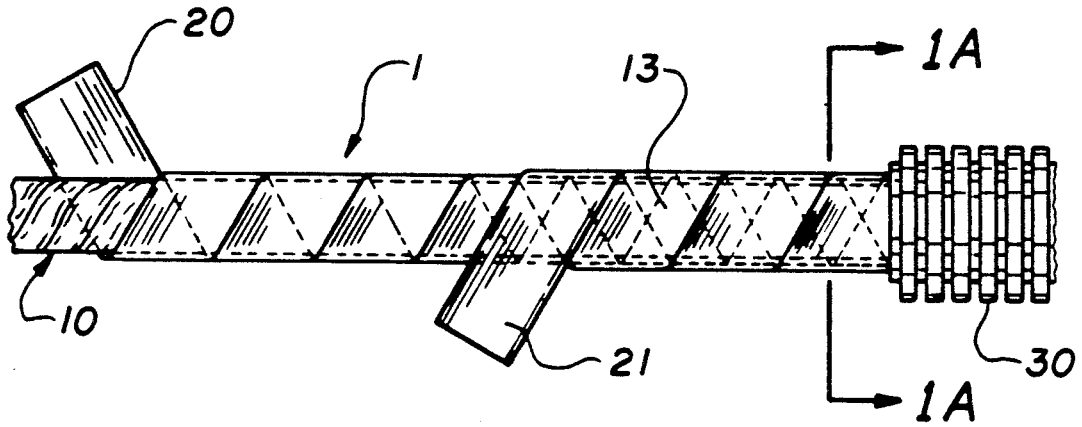
FIG. 1 is a longitudinal side view of the cable of the invention, with parts cut away.

FIG. 1 shows a portion of an electrical cable 1 adapted to carry electric current to lights, appliances, or other electrically operated apparatus located in homes or offices. The cable 1 comprises a plurality of conductors 10 formed into a bundle and surrounded by a barrier 13 and an armor sheath 30. The barrier 13 is applied directly about the bundle of conductors. The armor sheath 30 is formed directly about the barrier 13. The barrier which is formed of the polyester or polypropylene tape separates the armor sheath 30 from the bundle of conductors 10 and provides impact resistance against the armor sheath 30 being driven into contact with the conductors 10.

The plurality of conductors 10 are adapted to carry electric current to electrically operated apparatus. The conductors 10 must not become shorted, or the apparatus may become damaged or may fail. In a cable, the conductors may be bundled together in substantially parallel relationship, or the conductors may be twisted about each other. Each conductor 10 comprises a conductive element 12 covered by a sleeve of insulation 11. Additionally, a conductive element without an insulating layer may be incorporated into the bundle to serve as a ground wire. The conductive elements 12 may be a solid or stranded wire manufactured from copper, copper-clad aluminum, or any other acceptable aluminum alloy. The wire is typically designed to handle as least 600 volts AC at a temperature not exceeding 90° C. in dry conditions or 75° C. in wet conditions per UL 1569.

Figure 1A:
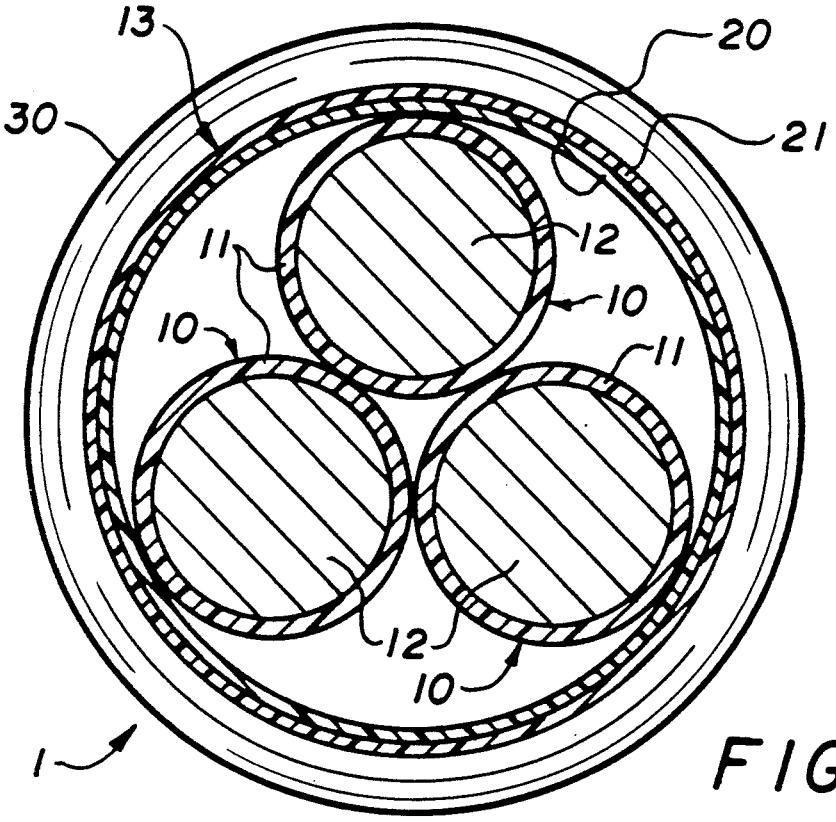
FIG. 1A is a cross-sectional view of the cable of FIG. 1, taken from the direction 1A—1A.

As shown in FIG. 1A, each conductive element 12 (except for the conductive element serving as a ground wire) is typically covered by a layer (sleeve) 11 of high-temperature insulation. The insulation 11 has a high dielectric strength and has the ability to withstand elevated temperatures. The sleeve of insulation 11, for example, may be polyethylene, polypropylene, ethylene propylene, rubber, nylon or other suitable material, including suitable combinations of materials. The insulation 11 may be applied by any conventional technique (e.g., extrusion) directly to the surface of the conductive element 12 and fits tightly thereto. The layer of insulation 11 covering each conductive element 12 typically is 0.045 inches to 0.080 inches in thickness for 6 AWG to 1000 KCMIL conductors type XHHW, for example, and covers the entire length of the conductive element 12. The insulation thickness varies depending upon the type of conductors used.

The conductors 10 are formed into a bundle and are surrounded by the barrier 13 and the armor sheath 30 to protect the conductors 10 from mechanical damage. The armor sheath 30 is typically formed from a smooth or corrugated metal with high strength characteristics, such as may be found with aluminum tape. The armor sheath 30 may also be formed of other metallic material such as bronze, stainless steel or nickle-copper alloy. The armor sheath 30 may be of various thicknesses, usually in a range of about 0.020–0.050 inches. The armor sheath 30 is typically formed of an interlocking helical fashion around the barrier 13 and the bundle of conductors 10 to provide the cable with a rounded configuration.

Figure 4:
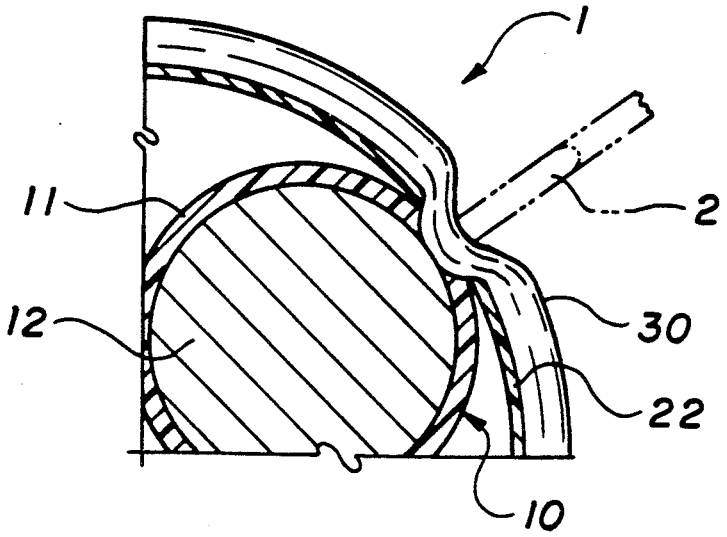
FIG. 4 is a schematic, fragmentary, cross-sectional view of the components of a cable having a barrier formed by a single layer of tape, showing the armor sheath being pierced by an object and contacting the conductive elements.

The armor sheath 30 resists most forms of mechanical damage, such as might result from objects impacting the cable 1 or from abuse during installation. However, under certain impact conditions, the armor sheath 30 can be driven into contact with the conductors 10 and short out the cable 1. For example, with a barrier consisting of a single layer of tape, if a force equivalent to a 50 lb. weight dropped from a height of 1 foot above the cable is applied to the cable, the armor sheath 30 may be driven through the barrier and into contact with the conductive elements 12 (as schematically shown in FIG. 4). If the armor sheath 30 is driven into contact with the conductive elements 12 it may short out the cable. Further, an object such as a nail, support or other hard, slender object may be forced against armor sheath and could pierce the armor sheath 30 and the barrier, contact the conductive elements and short out the cable 1.

According to the invention, the barrier 13 consists of polyester or polypropylene tape formed into a plurality of layers. In the cable of FIGS. 1, 1A, the polyester or polypropylene tape is formed into two layers 20, 21. The layer 20 extends the length of the bundle of conductors and is disposed directly against the bundle of conductors. The layer 21 also extends the length of the bundle of conductors and is disposed on top of the layer 20. A preferred form of tape is a polyester tape extruded of PET (polyethelene terephthalate) resin manufactured by or for E. I. Dupont de Nemours & Company and sold under the trademark Mylar. The barrier 13 absorbs impacts that might otherwise force the armor sheath 30 into contact with the conductive elements 12 of at least some of the conductors 10. Moreover, the barrier 13 resists objects penetrating the armor sheath 30 and contacting conductive elements of at least some of the conductors 10. In the preferred form of the invention, the tape has a thickness of about 1.5 mils to about 2.0 mils. Moreover, the tape has longitudinally extending corrugations providing a thickness of each layer of about 8.0 mils to about 10.0 miles and an overall barrier thickness of about 16.0 mils to about 20.0 mils.

In the embodiment of FIGS. 1, 1A, the layer 20 is formed by helically wrapping the polyester or polypropylene tape about the bundle of conductors over the length of the bundle of conductors, so that the helically wrapped tape covers the bundle of conductors. The tape can be helically wrapped with its edges in abutting (i.e., non-overlapping) relation or in overlapping relation. The layer 21 is formed by helically wrapping the polyester or polypropylene tape about the layer 20 with the edges of the helically wrapped tape in abutting or overlapping relation so that the helically wrapped layer 21 covers the helically wrapped layer 20. The helical windings of the layer 20 can be in the same or opposite direction relative to the direction of the helical windings of the layer 21.

Figure 2:
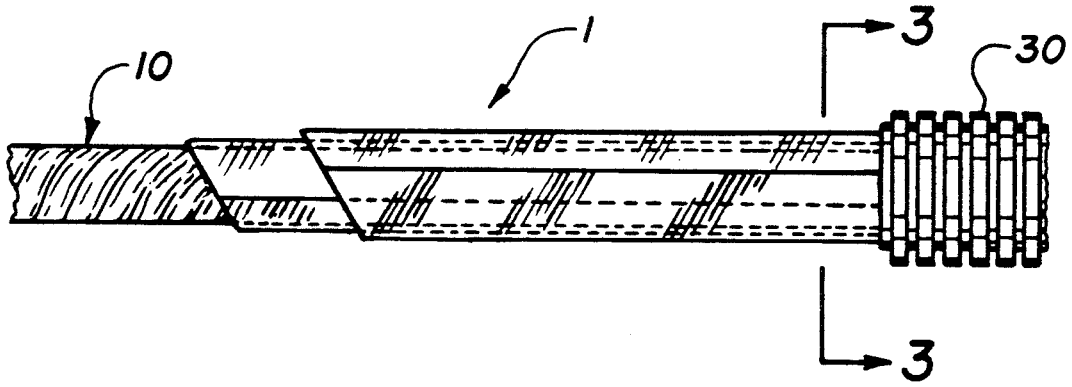
FIG. 2 is a longitudinal side view of a cable embodying a modified form of the invention, with parts cut away.
Figure 3:
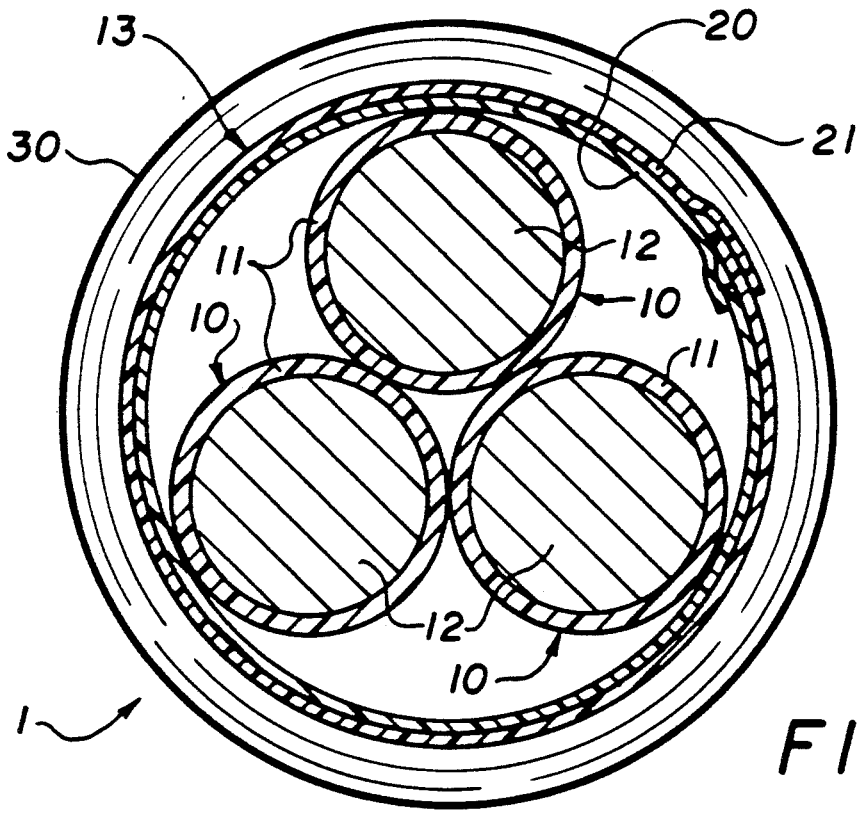
FIG. 3 is a cross-sectional view of the cable of FIG. 2, taken from the direction 3—3.

A modified way of forming the barrier 30 is shown in FIGS. 2, 3. In the cable of FIGS. 2, 3, the barrier 30 is formed by the same polyester or polypropylene tape, but each layer is formed by a length of the tape extended longitudinally over the extent of the bundle of conductors and wrapped about the bundle of conductors 10. A first layer 20 is formed by a length of tape extended longitudinally over the bundle of conductors and wrapped directly about the bundle of conductors. The other layer 21 of tape is formed by a length of the tape extended longitudinally over the first layer 20 and wrapped directly about the first layer. The polyester or polypropylene tape has a thickness of about 1.5 mils to about 2.0 mils. The tape has longitudinally extending corrugations, providing a thickness of each layer of about 8.0 mils to about 10.0 mils, and an overall barrier thickness of about 16.0 mils to about 20.0 mils. As seen in FIG. 3, in forming each of the layers 20, 21, longitudinal edges of the respective lengths of tape may be slightly overlapped so that each layer completely surrounds the bundle of conductors. Moreover, a binder thread (not shown) can be helically wound about the second layer 21 of tape to hold the layers 20, 21 of tape tightly against the bundle of conductors, if necessary.

In the embodiment of FIGS. 2 and 3, each length of tape can be (i) initially extended over the bundle or the first layer (as the case may be) and then wrapped all at once about the bundle or the first layer, or (ii) progressively extended over and wrapped around the bundle or the first layer. Reference to a length of tape being "extended over" the bundle or the first layer and then "wrapped" thereabout is intended to encompass both techniques.

In the preferred forms of the invention disclosed in each of the foregoing embodiments, the barrier formed by the layers 20, 21 of polyester or polypropylene tape has a total corrugated thickness of between about 16.0 mils and about 20.0 mils. The corrugations formed in the tape provide additional separation between the conductors 10 and the armor sheath 30.

Figure 5:
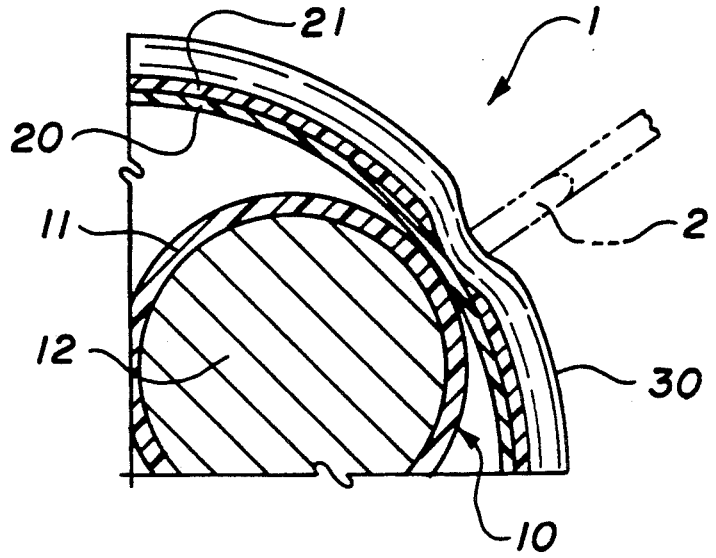
FIG. 5 is a schematic, fragmentary, cross-sectional view of the components of the cable of the present invention showing the armor sheath being pierced by a foreign object and not contacting the conductive elements.

FIG. 5 schematically shows a cable 1 constructed in accordance with the present invention wherein an object 2 impacting against the armor sheath 30 does not drive the armor sheath 30 through the barrier 13 and against the conductors 10. Applicant has found that by adding a second layer of impact-resistant material between the bundle of conductors 10 and the armor sheath 30, a cable is constructed which provides for a surprising increase in impact resistance along its length. The cable 1 in FIG. 5 is not shorted out because the two layers of tape 20, 21, disposed between the bundle of conductors 10 and the armor sheath 30, create an additional separation that the armor sheath 30 does not penetrate during impact. Moreover, the elastic qualities of the polyester or polypropylene tape resist the penetration of the armor sheath 30, and prevent the armor sheath 30 from contacting the conductors 10.

Cables illustrating features of the present invention were constructed and tested using conventional methods for impact resistance. The bundle of conductors 10 was wrapped with layers of Mylar tape and an armor sheath 30 in accordance with the present invention. The following table illustrates the dramatic improvement in impact resistance of a cable having two layers of tape as compared to a cable having only a single layer of tape.

Each number for the cable type represents the AWG number (size) of the conductive elements 12 in the cable. The last number in the series is the AWG number for the ground wire. The number 1/0 is the next larger AWG number after 1. The references "single" or "double" layer refers to layer(s) of Mylar tape having a thickness of 1.5 mils to 2.0 mils, and being longitudinally corrugated to a thickness of 8.0 mils to 10.0 mils. Double wraps were helically wound in the same direction, while "X" wraps were helically wound in opposite directions. The thickness of the armor sheath 30 was 0.025 inches. The thickness of the insulating layer around each conductive element was per UL 44 for type XHHW conductors. The tests were conducted on a 10 ft. sample of cable with a 50 lb. drop weight from a height of 1 foot above the sample. The results in each category are the total number of points that failed for seven (7) sample cables tested, with each cable being tested at ten (10) different locations, are shown in Table I below.

TABLE I

| | NUMBER OF POINTS FAILED | |
|---|---|---|
| Type of Cable | Single Layer | Double Layer |
| 1-1-1-3 | 17 | 1 |
| 4-4-4-6 | 15 | 1 |
| 1-1-1-3 | 18 | 0 |
| 1/0-1/0-1/0-2 | 17 | 5 |
| 2-2-2-2-4 | Not Tested | 1 |
| 2-2-2-2-4 X | Not Tested | 2 |

Some comparative data on cables with longitudinally applied tape barriers comprising a single layer of the Mylar tape described in the previous table versus a double layer of the Mylar tape according to the present invention, when subjected to the test of UL 1569, Section 19, is shown in Table II below.

TABLE II

| | Single Layer Impacts | | Double Layer-Longitudinal Impacts | |
|---|---|---|---|---|
| Type of Cable | Pass | Faults | Pass | Faults |
| 2-2-2-2-4 | 233 | 47 | 486 | 34 |
| 1-1-1-3 | 66 | 4 | 69 | 1 |
| 1/0-1/0-1/0-2 | 56 | 14 | 69 | 1 |
| 2/0-2/0-2/0-1 | 59 | 11 | 68 | 2 |

In the foregoing Table II, reference to "Faults" means that the impact caused the cable to short circuit. Reference to "Pass" means that impact did not cause the cable to short circuit at the point of impact.

The two layers of tape 20, 21 in the cable construction were found to substantially improve the impact resistance of the cable as compared to cables having only a single layer of tape. The barrier formed between the bundle of conductors 10 and the armor sheath 30 substantially reduced the possibility that the armor sheath 30, or an object penetrating the armor sheath 30, would be driven against the conductors 10 and short out the cable 1.

As seen from the foregoing discussion, the preferred forms of this invention comprise polyester or polypropylene tape formed into two layers 20, 21; the tape being about 1.5 mils to 2.0 mils thick and the corrugated thickness of each layer being about 8.0 mils to about 10.0 mils. Thus, the overall thickness of the barrier is preferably from about 16.0 mils to about 20.0 mils. However, it should be clear that additional layers of the polyester or polypropylene tape can be added, to increase the thickness of the barrier to provide even greater impact resistance. Applicants further believe it may be possible to achieve adequate impact resistance, and yet maintain a relatively small cable profile, with thinner polyester or polypropylene tapes wrapped in more than two layers, where the overall thickness of the barrier is maintained in the 16.0 mil to 20.0 mil range.

Also, applicants believe that the advantages of the present invention in minimizing the risks of short circuiting a cable by an impact are particularly significant when the individual conductors have insulation wall thicknesses of 55 mils or less.

It will be apparent from the foregoing that changes may be made in the details in construction and configuration, without departing from the scope and spirit of the invention as defined in the following claims.

What is claimed is:

1. An electrical cable structure comprising a plurality of conductors formed into a bundle having a longitudinal extent, an armor sheath surrounding said bundle of conductors, and a barrier of non-conductive material disposed immediately adjacent to the outer side of said bundle of conductors and immediately adjacent to the inner side of said armor sheath, said barrier separating said armor sheath from said bundle of conductors and providing impact resistance against said armor sheath being driven into contact with any of said plurality of conductors, said barrier consisting essentially of two lengths of polymeric tape, each having a thickness of between about 1.5 mils and about 2.0 mils, one of said lengths of said polymeric tape being extended over the longitudinal extent of said bundle of conductors and being wrapped directly about said bundle of conductors to form a first layer of said polymeric tape, the other of said lengths of polymeric tape being extended over the longitudinal extent of said first layer and being wrapped directly about said first layer to form a second layer of said polymeric tape which surrounds said first layer, said polymeric tape comprising polymeric material taken from a group consisting of polyester and polypropylene.

2. An electrical cable structure as defined in claim 1, wherein said barrier consists essentially of said first and second layers of polymeric tape.

3. An electrical cable structure as defined in any of claims 2, wherein said polymeric tape has longitudinally extending corrugations and each of said first and second layers has a thickness of about 8.0 mils to about 10.0 mils, said barrier having a thickness of about 16.0 mils to about 20.0 mils.

4. An electrical cable structure as defined in claim 3 wherein said armor sheath is formed of electrically conductive metal.

5. An electrical cable structure comprising a plurality of conductors formed into a bundle, an armor sheath surrounding said bundle of conductors, and a barrier of non-conductive material disposed immediately adjacent to the outer side of said bundle of conductors and immediately adjacent to the inner side of said armor sheath, said barrier separating said armor sheath from said bundle of conductors and providing impact resistance against said armor sheath being driven into contact with any of said plurality of conductors, said barrier consisting essentially of polymeric tape comprising polymeric material taken from a group consisting of polyester and polypropylene and having a thickness of between 1.5 mils and about 2.0 mils, said polymeric tape being helically wrapped directly about said bundle of conductors over the length of said bundle of conductors to form a first layer of said polymeric tape, and said polymeric tape being helically wrapped directly over the length of said first layer to form a second layer of said polymeric tape which surrounds said first layer.

6. An electrical cable structure as defined in claim 5, wherein said barrier consists essentially of said first and second layers of polymeric tape.

7. An electrical cable structure comprising a plurality of conductors formed into a bundle, an armor sheath surrounding said bundle of conductors, and a barrier of non-conductive material disposed immediately adjacent to the outer side of said bundle of conductors and immediately adjacent to the inner side of said armor sheath, said barrier separating said armor sheath from said bundle of conductors and providing impact resistance against said armor sheath being driven into contact with any of said plurality of conductors, said barrier consisting essentially of polymeric tape comprising polymeric material taken from a group consisting of polyester and polypropylene and having a thickness of between about 1.5 mils to about 2.0 mils, said polymeric tape formed into a plurality of layers each extending over the length of the bundle of conductors, said polymeric tape being helically wrapped about said bundle of conductors over the length of said bundle of conductors to form at least first and second layers, and wherein said barrier consists essentially of said plurality of layers of polymeric tape.

8. An electrical cable structure comprising a plurality of conductors formed into a bundle, an armor sheath surrounding said bundle of conductors, and a barrier of non-conductive material disposed immediately adjacent to the outer side of said bundle of conductors and immediately adjacent to the inner side of said armor sheath, said barrier separating said armor sheath from said bundle of conductors and providing impact resistance against said armor sheath being driven into contact with any of said plurality of conductors, said barrier having a thickness of about 16.0 mils to about 20.0 mils and consisting essentially of polymeric tape formed in to a plurality of layers, each layer extending over the length of the bundle of conductors, and said polymeric tape comprising polymeric material taken from a group consisting of polyester and polypropylene and having longitudinally extending corrugations.

9. An electrical cable structure as defined in claim 8, wherein the thickness of said polymeric tape is from about 1.5 mils to about 2.0 mils.

10. An electrical cable structure as defined in claim 9, wherein said bundle of conductors has a longitudinal extent and said barrier comprises at least one length of said polymeric tape which is extended longitudinally over the extent of said bundle of conductors and is wrapped about the bundle of conductors to form at least one of said layers.

11. An electrical cable structure as defined in any one of claims 8–10, wherein said armor sheath is formed of electrically conductive metal.

* * * * *

UNITED STATES PATENT AND TRADEMARK OFFICE

CERTIFICATE OF CORRECTION

PATENT NO. : 5,153,381

DATED : October 6, 1992

INVENTOR(S) : Ganatra et al.

It is certified that error appears in the above—identified patent and that said Letters Patent is hereby corrected as shown below:

Col. 7, lines 63 and 64, delete "in any of claims 2" and insert therefor --in any of claims 2, 6 or 7--.

Signed and Sealed this

Thirteenth Day of June, 1995

Bruce Lehman

*Attest:*

BRUCE LEHMAN

*Attesting Officer*

*Commissioner of Patents and Trademarks*